United States Patent [19]

van der Lely et al.

[11] 4,048,769

[45] Sept. 20, 1977

[54] BUILDINGS FORMED BY ONE OR MORE PREFABRICATED BUILDING SECTIONS, AND METHOD OF MANUFACTURING PREFABRICATED BUILDING SECTIONS

[76] Inventors: Cornelis van der Lely, 7, Bruschenrain, Zug; Hendricus Jacobus Cornelis Nieuwenhoven, Hirssattelweg, 6340 Baar, both of Switzerland

[21] Appl. No.: 643,002

[22] Filed: Dec. 22, 1975

Related U.S. Application Data

[63] Continuation of Ser. No. 439,591, Feb. 4, 1974, abandoned.

[30] Foreign Application Priority Data

Feb. 9, 1973 Netherlands ..... 7301828

[51] Int. Cl.[2] ..... E04H 1/12

[52] U.S. Cl. ..... 52/79.7; 52/206; 52/601

[58] Field of Search ..... 52/79, 236, 206, 601

[56] References Cited

U.S. PATENT DOCUMENTS

| | | | |
|---|---|---|---|
| 991,942 | 5/1911 | Boyd | 52/206 |
| 3,466,818 | 9/1969 | van der Lely | 52/236 |

FOREIGN PATENT DOCUMENTS

| | | | |
|---|---|---|---|
| 126,397 | 12/1947 | Australia | 52/601 |
| 1,011,914 | 1/1965 | United Kingdom | 52/236 |

*Primary Examiner*—John E. Murtagh

*Attorney, Agent, or Firm*—Mason, Mason & Albright

[57] ABSTRACT

A two story building consistng of three elongated box-shaped prefabricated sections wherein there are two sections connected together side by side on the ground floor and a further section is stacked on one of the ground floor sections to comprise the second floor. Each section includes a framework of metal beams and the walls of the section are defined at least in part by the metal beams of the framework. The walls may include openings for doors, windows and interior passageways. Each wall is composed of cast concrete and has embedded therein a plurality of stiffening bars. The stiffening bars are inclined to both the horizontal and vertical and have bent-over ends which are disposed at corners of the walls without touching the proximate metal framework. The stiffening bars also have portions near each corner of an opening and, between openings and vertical framework components, the stiffening bars cross each other to produce a truss-like structure embedded in the concrete of the walls.

36 Claims, 7 Drawing Figures

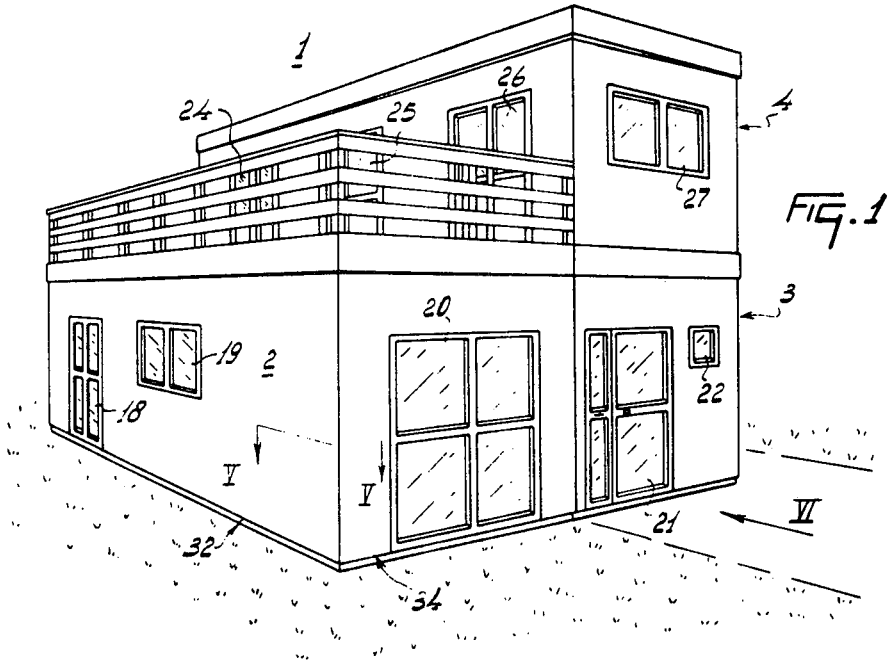
FIG. 1
FIG. 2
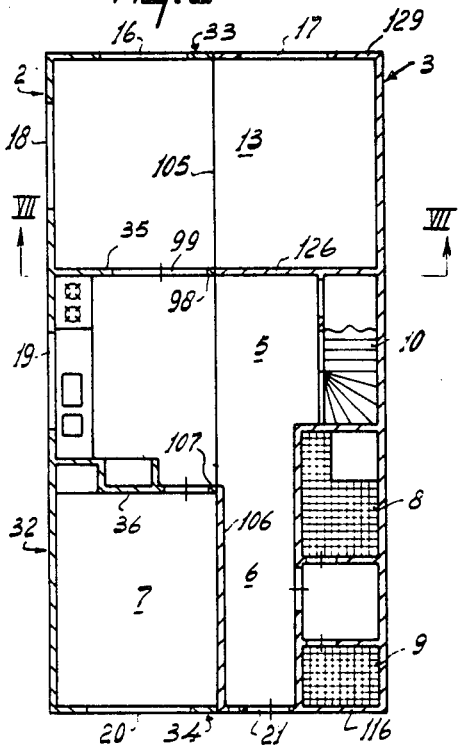
FIG. 3
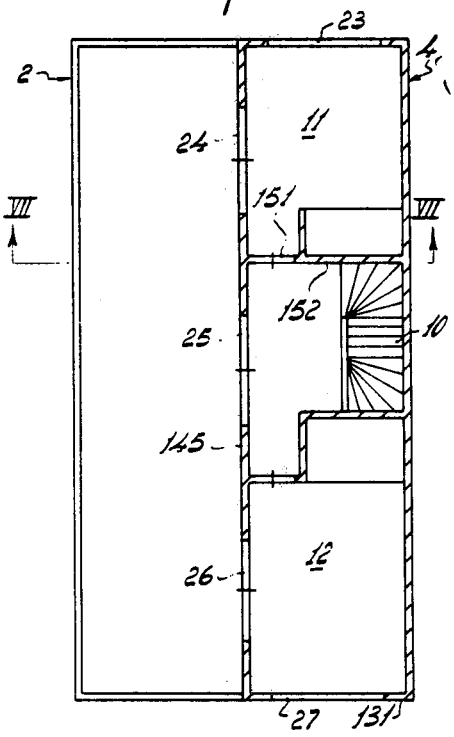

BUILDINGS FORMED BY ONE OR MORE PREFABRICATED BUILDING SECTIONS, AND METHOD OF MANUFACTURING PREFABRICATED BUILDING SECTIONS

SUMMARY OF THE INVENTION

This is a continuing application of application Ser. No. 439,591 filed Feb. 4, 1974, now abandoned.

This invention relates to buildings formed by one or more prefabricated, box-shaped sections, and methods of manufacturing prefabricated building sections.

According to one aspect of the present invention there is provided a building comprising at least one prefabricated, box-shaped building section enclosing at least part of one or more living areas and having at least one wall that comprises a slab of cast material which is provided with one or more stiffening bars.

According to another aspect of the present invention there is provided a method of manufacturing a space-bounding building section for a building, wherein for the section a floor, a top and an upright wall are manufactured independently of each other, and at least one of these parts of a section is provided with a wall slab having stiffening bars, these parts then being fastened to each other to form the space-bounding building section.

BRIEF DESCRIPTION OF THE INVENTION

For a better understanding of the invention and to show how the same may be carried into effect, reference will now be made by way of example to the accompanying drawings, in which:

FIG. 1 is a perspective view of a two story building formed by a plurality of prefabricated sections, FIG. 2 is a plan of the ground floor of the building shown in FIG. 1, FIG. 3 is a plan of the upper story of the building shown in FIG. 1, FIG. 4 is a schematic perspective view of the building shown in FIG. 1, a facade cover being omitted, FIG. 5 is an enlarged sectional view of a corner of one of the prefabricated building sections taken on the line V—V in FIG. 1, FIG. 6 is an end view of the building of FIG. 1, viewed in the direction of the arrow VI in FIG. 1, a facade cover being omitted, and FIG. 7 is a vertical sectional view of the building shown in FIG. 1 taken on the line VII—VII in FIGS. 2 and 3.

DESCRIPTION OF THE PREFERRED EMBODIMENTS

Figure 4:
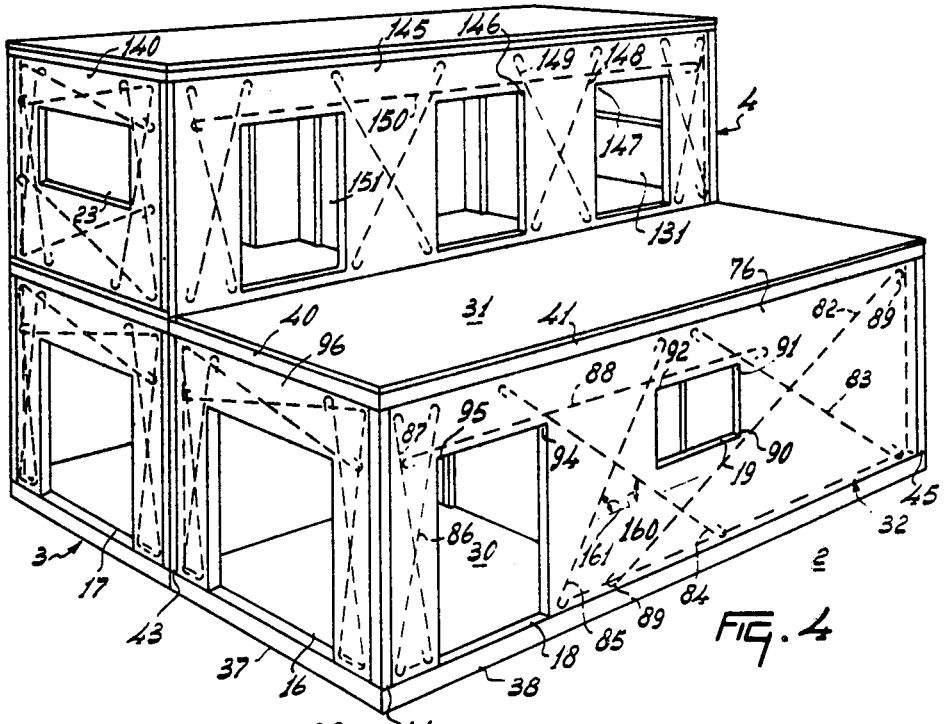

The building 1 shown in FIG. 1 is formed by three prefabricated, space-bounding building sections 2, 3 and 4. These sections, as will particularly be apparent from FIGS. 1 and 4, each have the shape of a parallelepiped, the sections 2 and 3 joining each other along their long sides and forming together the ground floor of the building 1. The section 4 is disposed above the section 3 and forms the upper story of the building 1. The sections 2 and 3 together include a central living area 5, which constitutes at the same time a kitchen area, to which leads a corridor 6. The section 2 further includes a room 7, and a further room 13 extends over both the sections 2 and 3. The section 3 further includes a washing area 8 and a toilet area 9. From the central area 5 a staircase 10 leads to a landing between two rooms 11 and 12 in the section 4.

The ground floor formed by the sections 2 and 3 has two windows 16 and 17 at one end. At the opposite end the sections 2 and 3 have windows 20, an entrance 21 and a window 22. In one long facade of the section 2, forming the outer wall of the building, windows 18 and 19 are provided. At its end above said one end of the section 3, the section 4 has a window 23, and at its opposite end a window 27. In one long facade the section 4 has three windows 24, 25 and 26.

The section 2 includes a floor 30, a top 31, a long wall 32, short walls 33 and 34, and partition walls 35 and 36. The floor 30 includes a frame of four peripheral beams, of which FIG. 4 shows the beams 37 and 38 and FIG. 6 the beam 39, the fourth beam, opposite the beam 38, not being shown in the drawings. The top 31 includes, in similar manner, a rectangular, peripheral frame formed by beams 40, 41 and 42 and a fourth beam (not shown) which is parallel to the beam 41. The rectangular frames of the floor 30 and of the top 31 are interconnected by four upright beams 43, 44, 45 and 46 constituting columns. The beams 37 to 46 constitute a parallelepiped-shaped frame of the section, to which are fastened the further wall structures, the floor structure and a top, including a ceiling structure and eventually a roof. That is, the parallelepiped-shaped frame determines the main form of the building section and is provided at the desired places with closed wall structures, a floor and a top.

Figure 5:
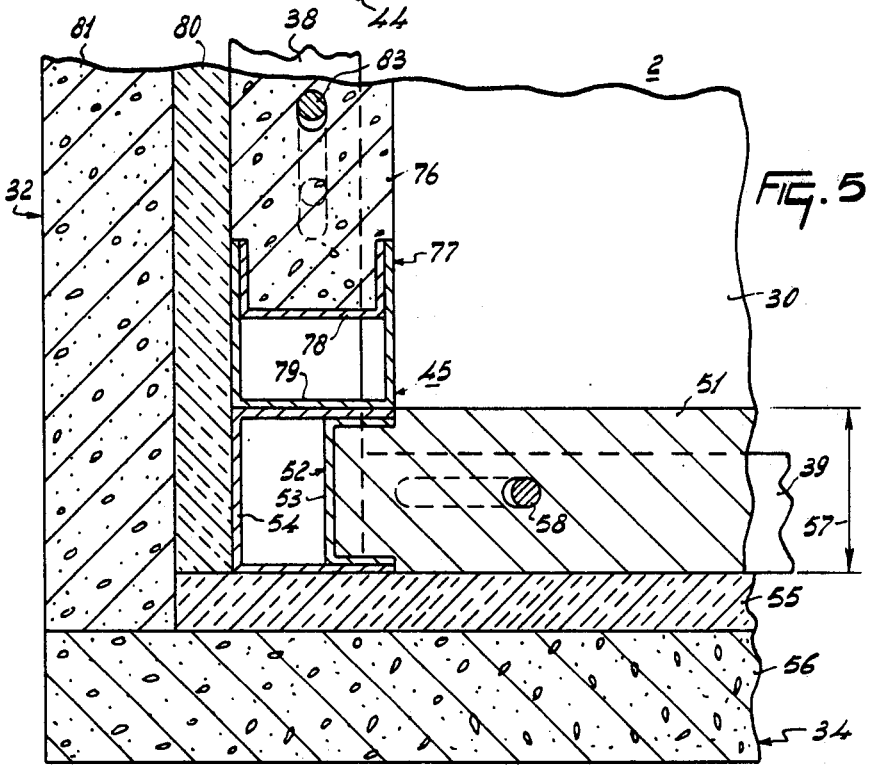
Figure 6:
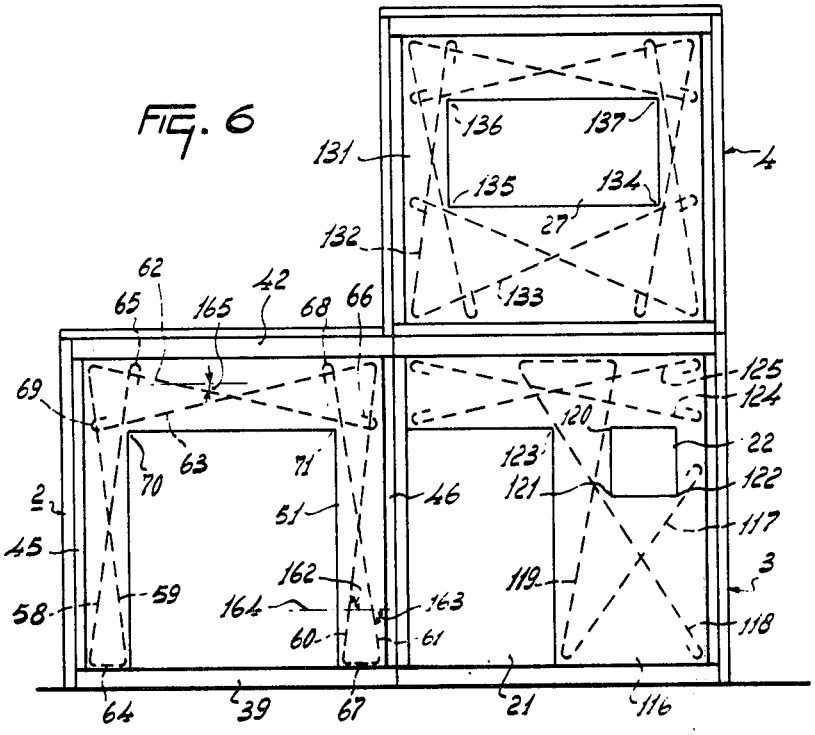

FIG. 5 shows in detail the wall 34 of the section 2. The wall 34 constitutes an outer wall of the building and which comprises a slab 51 of concrete arranged between part of the vertical beam 45 and the beam 46, the latter not being visible in FIG. 5. The part of the beam 45 in question, as designated in FIG. 5, consists of two channel-section beams 53 and 54, the beam 53 being located inside the limbs of the beam 54. In order to obtain a satisfactory outer wall structure the concrete slab 51 is provided on the outer side with a layer of insulating material 55 to which is applied a facade cover plate 56, which is made of concrete in this embodiment. The concrete slab 51 has a thickness 57 equal to the width of the beam part 52 so that the beam part 52 joins the vertical peripheral edge of the slab 51 throughout the thickness 57 thereof. The slab 51 is preferably made from light-weight concrete. The wall 34 has an opening for the window 20 and the slab 51 has a corresponding opening as is shown in FIG. 6.

The concrete slab 51 is provided with stiffening bars for reinforcing the section and the wall 34. The stiffening bars are disposed in the wall slab 51 so that each of the wall portions around the opening for the window 20 has a cross of bars, as is shown in FIG. 6. To one side of the window opening two bars 58 and 59 are disposed cross-wise, and likewise to the other side of the window opening bars 60 and 61 are provided cross-wise. Bars 62 and 63 are disposed cross-wise in the portion above the window opening. The bars 58, 59 and 62 are formed by a single, suitably bent, bar, the bars 58 and 59 being connected with each other by a bar portion 64 that is in the lower part of the wall slab 51. The free end of the bar 58 is terminated by a bent-over portion 65, and likewise the free end of the bar 62 is terminated by a bent-over portion 66. In similar manner a single bar forming the bars 61, 60 and 63 is terminated at its free ends with portions 68 and 69 bent-over through 180°. As will be apparent from FIG. 5, the stiffening bars are located approximately midway through the thickness 57 of the concrete slab 51. The ends of the stiffening bars are located near the periphery of the concrete slab 51, but they are not connected with the vertical beams 46 or 52, nor with the horizontal beams 39 or 41. The bars are arranged so that one or more of them extend along the corners of the opening in the wall slab for the window 20.

The wall 32 in a long side of the section 2 is constructed mainly in the same way as is illustrated for the wall 34, having a concrete slab 76 between parts of the two vertical beams 44 and 45. The part of the beam 45 in question is designated by the reference numeral 77 in FIG. 5. This part (and the corresponding part of the beams 44) is composed of two channel-section beams 78 and 79, one of which is located inside the limbs of the other, as is shown in FIG. 5. On the outer face of the slab 76 there is a layer of insulating material 80 which is covered by a layer 81, which is made in this embodiment of hard concrete. The slab 76 of light concrete is reinforced by stiffening bars arranged so that the wall portions of the slab 76 around the openings for the windows 18 and 19 are each reinforced by crossing stiffening bars as is shown in FIG. 4. Of these bars, two crossing bars 82 and 83 are disposed mainly between the beam 45 and the window 19. Between the windows 18 and 19 two bars 84 and 85 are arranged cross-wise, and between the beam 44 and the window 18 two bars 86 and 87 are arranged cross-wise. Also in the wall slab 76 a bar 88 extends horizontally at a short distance above the top of the openings for the windows 18 and 19. Each of the bars, as is shown for the bar 82 at 89, is provided with ends bent over through 180°. The bent-over ends of the bars 82 to 87 inclined to the horizontal are located near the bottom or top of the slab 76. The bars 82, 83 and 85 pass close to the corners 90, 91 and 92 of the opening for the window 19. The bars 84 and 86 pass close to the corners 94 and 95 of the opening for the window 18. The bars in the wall slab 76 are completely embedded in the material of the slab 76 and are not connected with the beams 38 and 41 or with the beam 45.

Figure 7:
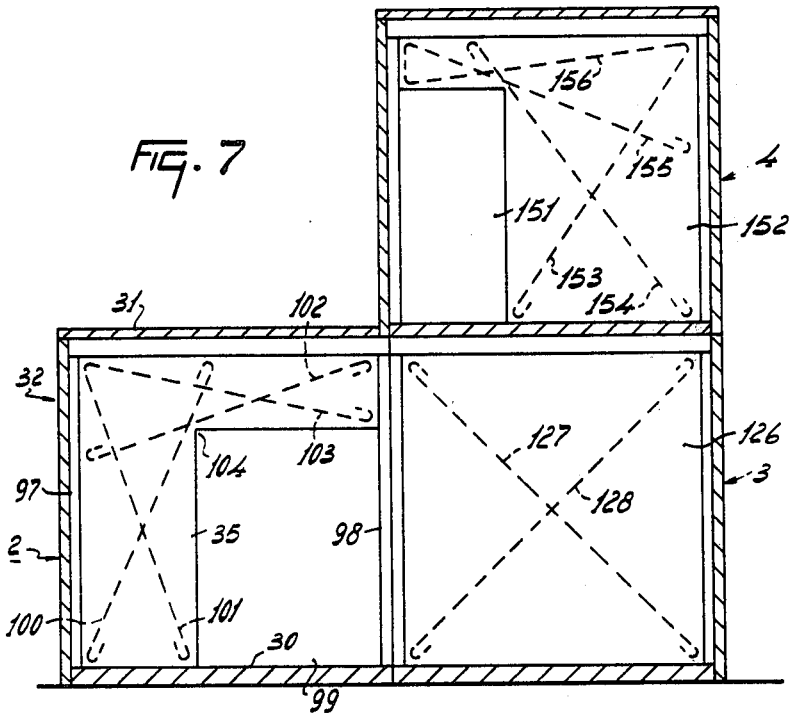

The beam part 77 of the wall 32 and the beam part 52 of the wall 34 constitute together the beam 45. The beam 46 is formed by only one pair of beams, in the manner of the beam part 52. The wall 33 is constructed in the same manner as the wall 34, as will be particularly evident from FIGS. 4 and 6. The construction of the wall 34 with the concrete slab and the stiffening bars and the insulation with the covering layer are therefore not shown in detail here. FIGS. 4, 6 and 7 show, for the walls forming outer walls of the building, only the inner wall slabs such as the slabs 51 and 76 of the walls 32 and 34. The insulation layers with the covering layers, such as the insulation layers 55 and 80 and the layers 56 and 81 for the walls 32 and 34 are omitted to enable showing the location of the stiffening bars in the inner wall slabs. The beam 44 is formed in the same manner as is shown for the beam 45 in FIG. 5 by joined vertical beams along the edges of the wall slabs of the walls 32 and 33. The beam 43 is of the same form as the beam 46 and is constituted by only one pair of beams in the manner of the beam part 52 of FIG. 5.

The inner partition walls 35 and 36 of the section 2 are constructed in the same manner as is shown for the wall slabs 51 and 76. These inner partition walls 35 and 36 need not be provided on one side or the other with a layer of insulating material and a covering layer. The walls 35 and 36 basically consist of a wall slab of concrete corresponding with the slabs 51 and 76 and may be provided on one side or on both sides with a desired decorative finish. It will be seen from FIG. 7 that the inner walls are also provided with stiffening bars in the manner as is shown for the wall slabs 51 and 76 of the walls 34 and 32. The wall slab of the wall 35 is disposed between vertical beams 97 and 98 corresponding with the beam parts 52 and 77. The slab of the wall 35 has an opening 99 for a door between the room 13 and the living area 5, and is provided around the opening 99 which crossing bars such as bars 100 and 101 at one side of the opening 99 and bars 102 and 103 above the opening 99. The bars 100 and 102 are arranged so that they extend past the corner 104 of the opening 99. The bars 101 and 103 are formed by a single curved bar. The bars 100 to 103 are embedded completely in the material of the slab of the wall 35 and they are not connected with beams at the periphery of this wall slab. The ends of the bars have portions bent over through 180° for obtaining a satisfactory anchorage of the bar ends in the material of the slab. The beams 97 and 98 are connected at their bottom and top ends with the beams of the rectangular frames in the bottom and top of the section 2.

The long side 105 of the section 2, as is shown in FIG. 2, is completely open and joins rooms located in the section 3 and an inner partition wall 106 formed by a long side part of the section 3. The open side 105 of the section 2 is provided with the beam 98 and a corresponding beam 107 in a vertical end of the inner partition wall 36. The bottom and the top of the section 2 are thus supported along the long side 105 by the beams 98 and 107.

When manufacturing a section such as the section 2 the floor, the top and the walls, for example for the section 2 the floor 30, the top 31 and the walls 33, 32, 34, 35 and 36 are made independently of each other. The floor slab is provided during its prefabrication with its frame of beams 37, 38 and 39 along or near its periphery. The top 31 is prefabricated with its peripheral beams 40, 41 and 42. Each wall 32, 33, 34, 35 and 36 is prefabricated as a unit formed of the parts as already described. The space-bounding section is then formed by rigidly securing the prefabricated walls at the lower ends of their vertical beams to the peripheral beams of the floor 30, that is the beams 46 and 52 to the beam 39. The top 31 is secured by the peripheral beams 40, 41, 42 to the top ends of the beams in the vertical ends of the walls. The beams, which are preferably made of metal, constitute a three-dimensional frame, the beams lying mainly along the circumferential edges of the section. In this manner a space-bounding section is formed. As will be apparent from the Figures, the section may be divided by inner partition walls in accordance with the division of the building as desired. It will be seen from the Figures that the various walls such as the inner and outer walls may be provided at the desired areas with door or window openings or both.

As is shown for the section 2, the sections 3 and 4 are constructed in similar manner. FIGS. 4, 6 and 7 show that the walls of these sections are provided with slabs of light concrete corresponding with the wall slabs 51 and 76 of FIG. 5. These wall slabs are provided with stiffening bars so that the bars cross each other in the wall surfaces. The walls are divided around the openings for windows or doors or both into portions each having a set of crossing stiffening bars as will be seen from FIGS. 4, 6 and 7. These bars are constructed in the same manner as shown for the walls of the section 2. For this reason further details may be omitted for the sections 3 and 4. In a wall such as the wall 116 of the section 3 where a door and a window are provided, the various wall portions around the door and window openings have crossing bars, such as the bars 117, 118 and 119. These bars are integral with one another with the bar 118 crossing the bars 117 and 119. In order to reinforce the corners of the opening for the window 22 the bars 118 and 119 extend past the corners 121 and 129, whereas the bar 117 extends past the corner 122 of the window 22. The bar 118 furthermore extends past the corner 123 of the opening for the door 21. In the portion of the wall 116 above the door and window openings two bars 124 and 125 are arranged cross-wise.

A wall such as the closed wall 126, which forms an inner wall in the section 3, is provided with two crossing bars 127 and 128 extending diagonally and having their ends located at the corners in the wall 126 (FIG. 7). The wall 129 corresponds with the wall 33 in the section 2 so that further details may be omitted.

FIG. 6 shows for the section 4 that around the opening such as the opening for the window 27 located centrally of the wall, for example, the wall 131, crossing bars are provided at the bottom and top and on one and the other sides of the window opening. As will be apparent from FIG. 6 the crossing bars may be simply made pairwise from a single piece of material, for example the bars 132 and 133. Near the corners of the windows one or more bars are provided. The opposite wall of the section 4 is constructed in the same manner as the wall 131. In the long wall 145 of the section 4, between the windows 24, 25 and 26, crossing bars are provided, as on the opposite sides of the windows 24 and 26 (FIG. 4). The crossing bars, as stated above, are always located approximately midway through the thickness of the wall and are free of the beams surrounding the wall. The bars preferably extend so that they support the corners of the window openings, for example, the corners 146, 147. The bar 148 extends past the corner 147 and the bar 149 extends past the corner 146. At a short distance above the top of the window openings 24, 25 and 26 a horizontal bar 150 extends over substantially the whole length of the wall 145. An inner wall such as the inner wall 152 in the section 4, having a smaller door opening 151, may be provided in the wall portions around the door opening with crossing bars as is shown in FIG. 7. At the side of the door opening two crossing bars 153 and 154 are provided, and the wall portion above the door opening is provided with parts of two bars 155 and 156. The bars 155, 156 and 153 are integral with each other. As in the other walls the ends of the bars have portions bent over through 180°.

Like the section 2 the sections3 and sections 3 are assembled from independently manufactured floor panels, a panel for the top and the wall panels. These prefabricated panels are coupled with one another by interconnecting the beams of the frames of the floor and the top and the vertical beams of the wall panels.

The use of the stiffening bars in the concrete slabs of the walls as shown in the Figures and as described in the foregoing provides a particularly satisfactory rigidity for the sections so that in particular the forces or components of forces exerted at right angles on both the long and short sides can be readily absorbed. Owing to the stiffening bars the walls have a great rigidity, particularly in a direction parallel to the plane of the wall so that the thickness of the walls need only be comparatively small. The bars 82 to 87 in the wall 32 provide particularly a resistance to the forces exerted thereon in a direction parallel to the wall 32, that is to say, forces exerted on the section 2 at right angles to the walls 33 and 34. The inclined position of the bars 82 to 87 to the horizontal plane in the concrete slab 51 provides a great resistance of the wall to forces exerted on the wall parallel to the plane of the wall.

A particularly satisfying rigidity of a wall is provided by bars arranged at an angle of about 45° to the horizontal plane, for example, the bars 84 and 85 being at angles 160 and 161 of about 45° to the horizontal plane. The bars 82 and 83 are at angles of less than 45° to the horizontal plane. It is particularly advantageous for other bars such as the bars 87 and 88 to be at angles of more than 45° to the horizontal plane.

In order to reinforce the concrete slabs near the corners of the openings for the windows such as the windows 18 and 19 in the slab 76, it is advantageous to provide bars near the corners such as the corners 94, 92, 95, 90 and 91. It is particularly advantageous for the bars to extend past three corners so that they are at angles of about 45° to the edges of the window openings. The bars 84 and 85, for example, are at angles of about 45° to the top edges of the window openings 18 and 19.

By example, the forces exerted at right angles to the longitudinal plane of the wall 32 of the section 2 can be advantageously absorbed by the walls 33, 34 and 35. In order to ensure a great resistance of the walls 33 – 35 against the forces just mentioned the walls such as the wall 34 are provided with stiffening bars such as the bars 58 to 63 in the wall slab 51, which bars are preferably made of metal. The bars 58, 59, 60 and 61 are at angles 162 and 163 of about 70° to the horizontal plane 164. It is particularly advantageous for the bars 62 and 63 to be at angles 165 of about 20° to the horizontal plane, so that they constitute the complements of the angles 162 and 163. The walls are reinforced very advantageously without the need for a comparatively heavy structure.

It is particularly advantageous to arrange the stiffening bars in the portions of the walls, for example, the wall slab 51, joining peripheral beams of the frame of the section. These beams join the concrete slab preferably throughout the thickness thereof.

The wall panels consisting of or comprising a wall slab such as the wall slab 51, which is wholly or partly surrounded by peripheral beams and reinforced by stiffening bars, which are substantially completely embedded in the material of the wall slab, has a structure of high resistance as compared with the weight and the thickness of the wall. A reinforcement of a section in the manner described above against forces tending to deform the walls is particularly important for space-bounding, prefabricated sections, which are transported to the building site and to their positions in the building on the site. During transport of the sections from the factory to the building site particularly harmful forces may be exerted on the sections. These forces can be satisfactorily absorbed by the slabs in the walls reinforced by the stiffening bars.

A reinforced wall slab such as the wall slab 51 can be readily provided durng prefabrication with a layer of insulating material and an outer layer such as the layers 55 and 56. The insulating layer 55 and the outer layer 56 are fastened by anchoring bars with the wall slab 51 or the vertical beams such as the beams 46 and 52, or both. If desired, the slab 51 may furthermore be reinforced by a reinforcing network of light bars in order to obtain a greater resistance of the wall slab 51 against forces exerted at right angles to the wall slab. For this purpose apart from the stiffening bars a reinforcement network can be arranged in the longitudinal plane of the wall slab 51 extending substantially throughout the material of the wall slab 51. Although in the embodiment shown vertical walls are provided with slabs with stiffening bars, the horizontal walls of a section, for example, the floor or the top or both may also be provided with a slab having stiffening bars. The stiffening bars are then preferably arranged in inclined positions to the circumferences.

Although various features of the invention described and illustrated in the accompanying drawings will be set forth in the following claims as inventive features, it is emphasized that the invention is not necessarily limited to those features and includes within its scope each part of every embodiment that has been described or illustrated or both in the accompanying drawings individually and in various combinations.

What we claim is:

1. A building comprising a plurality of prefabricated box-shaped sections, each said section having a framework of horizontally and vertically disposed metal beams whereby the walls of said sections each have a framework of horizontally and vertically disposed metal beams at the periphery thereof, at least one of said walls composed of cast material and having a substantially rectangular opening, at least three sides of said opening defined by said cast material, stiffening bars which are entirely encased in said cast material of said one wall, each of said stiffening bars being inclined relative to but not touching and spaced from both said vertically and horizontally disposed beams of said one wall, each corner of said opening having proximate thereto a portion of one of said inclined stiffening bars, said stiffening bar portion proximate each corner of the circumference of said opening being spaced therefrom within said cast material so as not to touch its respective said corner.

2. A building in accordance with claim 1, wherein each said inclined stiffening bars crosses at least another of said inclined stiffening bars.

3. A building comprising at least one prefabricated box-shaped building section enclosing at least part of the building's living area, said section having at least one vertically disposed rectangular wall which comprises a single slab of cast concrete, metal frame beams at least in part surrounding the outer periphery of said slab including the vertical edges thereof and joining the peripheral edges of said slab substantially over said slab's entire thickness, said slab including a plurality of stiffening bars embedded therein which are each inclined relative to each said metal frame beam and which are proximate to but not touching and spaced from said frame beams at each corner of said slab.

4. A building in accordance with claim 3, wherein all said stiffening bars are inclined relative to each said metal frame beam.

5. A building in accordance with claim 3, wherein said slab has a uniform thickness substantially throughout and said stiffening bars are embedded about midway through the slab's thickness.

6. A building in accordance with claim 5, wherein said metal beams at the vertical edges of said slab comprise channel beams so disposed that the vertical edge portion of said slab is received in the channel of said corresponding metal beam, at least one said stiffening bar having an end portion embedded in said slab proximate said edge portion, said end portion spaced equidistant between the parallel opposite sides of said corresponding channel beam.

7. A building as claimed in claim 3, wherein the ends of each stiffening bar are located proximate the circumference of said slab.

8. A building as claimed in claim 7, wherein the section comprises said frame beams and further frame beams which form a three-dimensional frame, said beams being located substantially along the peripheral edges of the section.

9. A building as claimed in claim 8, wherein the section comprises a substantially closed floor and a substantially closed top.

10. A building as claimed in claim 8, wherein two said stiffening bars are arranged crosswise in said wall, each said bar commencing proximate a different corner of said wall.

11. A building as claimed in claim 10, wherein said wall is provided with one opening.

12. A building as claimed in claim 11, wherein, in the portions of said wall on each side of said opening, two crossing stiffening bars are provided.

13. A building as claimed in claim 12, wherein said opening includes a corner, a said stiffening bar extends near said corner.

14. A building as claimed in claim 13, wherein said last-mentioned stiffening bar extends at an angle of about 45° to the edges of said opening and the horizontal at said corner.

15. A building as claimed in claim 12, wherein along the top of said opening in said slab a further stiffening bar is arranged in a substantially horizontal direction spaced a short distance above the top edge of said opening.

16. A building as claimed in claim 12, wherein each said stiffening bar in said wall is provided at one end with a bent-over portion.

17. A building as claimed in claim 16, wherein said portion is bent through an angle of substantially 180°.

18. A building as claimed in claim 17, wherein at least two stiffening bars in said wall are connected with each other.

19. A building as claimed in claim 18, wherein the last-mentioned two connected bars are integral with each other.

20. A building as claimed in claim 3, wherein said wall forms part of an outer wall of the building, said wall comprising a slab covered on the outer side of the building with a first layer comprising insulating material and a second protective layer outside said first layer.

21. A building as claimed in claim 12, wherein said stiffening bars are located substantially midway through the thickness of said slab.

22. A building as claimed in claim 9, wherein the section has basically the shape of a parallelepiped.

23. A building comprising at least one prefabricated box-shaped building section which encloses at least part of the building's living area, said section being elongated and having only one vertically disposed rectangular wall at each shorter end of said section, each said wall comprising a single slab of cast concrete having a uniform thickness substantially throughout, metal frame beams included in said wall at least in part surrounding the outer periphery of said slab, each said slab including a plurality of stiffening bars embedded therein, all of said stiffening bars being inclined relative to each of said frame beams surrounding the outer periphery of each said wall, the end portion of each said stiffening rod being proximate but not touching at least one of said frame beams.

24. A building in accordance with claim 23, wherein the end portion of each said stiffening rod includes a U-shaped part.

25. A building comprising at least one elongated prefabricated box-shaped building section which encloses at least part of the building's living area, said section having a wall at one shorter end thereof which is comprised of only a single slab of concrete which is surrounded at least in part by a framework of metal beams, a plurality of stiffening bars embedded in said slab, all of said stiffening bars being inclined relative to each of said metal beams, the end portions of each said stiffening bar being located proximate the periphery of said slab, said end portion of each said stiffening rod being located proximate to but separated from a said metal beam.

26. A building comprising at least one elongated prefabricated box-shaped building section which encloses at least part of the building's living area, said section having a wall at one longer end thereof which is comprised of only a single slab of concrete which is surrounded at least in part by a framework of metal beams, at least two horizontally spaced openings for receiving a window or door in said slab, a plurality of stiffening bars embedded in said slab, said stiffening bars being provided between said openings in said slab and between each said opening and a vertical edge of said slab which are inclined relative to said metal beams, a further stiffening bar embedded in said slab, said further stiffening bar arranged to extend over both said openings.

27. A building in accordance with claim 26, wherein the end portions of each said stiffening bar between said openings are located proximate to but not touching at least one said metal beam of said framework.

28. A building in accordance with claim 27, wherein said openings are each of a rectangular shape, at least one of said stiffening bars being proximate to and spaced from each corner of each of said openings.

29. A building comprising box-shaped prefabricated sections which enclose at least part of the building's living area, said sections having at least two adjoining vertically disposed rectangular walls each of which comprises a single slab of concrete having a uniform thickness substantially throughout, a framework of metal beams included in each said wall for each said slab, said metal beams joining and substantially surrounding each said slab, vertical metal beams of each said framework in each said wall in an adjoining relationship where said walls adjoin, each said vertical beam covering the entire vertical edge of the corresponding slab, each said slab including a plurality of stiffening bars embedded therein which are inclined relative to said metal beams, end portions of said stiffening bars being proximate to but not touching said frameworks, each said wall comprising a first layer composed of an insulating material covering said slab and said framework and a second protective layer outside said first layer.

30. A building in accordance with claim 29, wherein said walls are included in a single section and are perpendicular to each other.

31. A building comprised of a plurality of prefabricated elongated box-shaped sections, each said section having a framework of metal beams whereby the walls of said sections each have a surrounding framework of metal beams at the periphery thereof, each said wall composed of a cast material, stiffening bars encased in each said wall, said stiffening bars being entirely spaced from and inclined relative to the beams of said framework and having an end portion proximate to a corner of each wall but not touching said beams, said corner being defined by said framework, at least two of said inclined stiffening bars intersecting each other in each said wall.

32. A building comprising a plurality of prefabricated box-shaped sections, each said section having a framework or horizontal and vertical metal beams whereby the walls of said sections each have a framework of metal beams at the periphery thereof, at least one of said walls being of a uniform thickness substantially throughout and composed of a cast material, a rectangular opening through said cast material for a passageway in said wall, said opening having at least two of its sides defined by said metal beams of said framework and the other two sides defined by said cast material, stiffening bars entirely encased in said one wall, each of said stiffening bars being inclined relative to both said vertical beams and the horizontal beam, each corner of said opening which is defined at least in part by said cast material having proximate thereto a portion of one of said inclined stiffening bars.

33. A building comprising at least one prefabricated, box-shaped building section enclosing at least part of a living area and having at least one vertically disposed wall, said wall comprising a single slab only which is composed of cast concrete material and is provided with crossed stiffening bars, metal frame beams provided at the outer periphery only of said slab which at least in part surrounds said slab, each said stiffening bar being inclined relative to the horizontal and to each of the circumferential edges of said wall, said frame beams joining said slab substantially throughout said slab's thickness, each said stiffening bar being wholly spaced from said frame beams.

34. A building comprising at least one prefabricated box-shaped building section enclosing at least part of a living area and having at least one vertically disposed wall, said wall comprising a single slab only which is composed of cast concrete non-layered material and is provided with crossed stiffening bars, which are substantially completely embedded in said concrete material, metal frame beams provided at the outer periphery only of said slab which at least in part surround that slab, said stiffening bars each being inclined relative to the horizontal and not touching and spaced from said metal beams.

35. A building as claimed in claim 34, wherein each said stiffening bar is inclined relative to each of the circumferential edges of said wall.

36. A building as claimed in claim 35, wherein said frame beams join said slab substantially throughout said slab's thickness.

* * * * *